US011751648B2

(12) United States Patent
Wood et al.

(10) Patent No.: US 11,751,648 B2
(45) Date of Patent: Sep. 12, 2023

(54) COLLAPSIBLE TRAVEL CASE

(71) Applicant: A Wood Products LLC, Poway, CA (US)

(72) Inventors: Adam Wood, Poway, CA (US); Kevin Klemmt, Seattle, WA (US)

(73) Assignee: A Wood Products LLC, Poway, CA (US)

( * ) Notice: Subject to any disclaimer, the term of this patent is extended or adjusted under 35 U.S.C. 154(b) by 286 days.

(21) Appl. No.: 17/191,533

(22) Filed: Mar. 3, 2021

(65) Prior Publication Data

US 2021/0361043 A1 Nov. 25, 2021

Related U.S. Application Data

(60) Provisional application No. 63/029,113, filed on May 22, 2020.

(51) Int. Cl.
*A45C 7/00* (2006.01)
*A45C 13/02* (2006.01)
(Continued)

(52) U.S. Cl.
CPC ..... *A45C 3/001* (2013.01); *A45C 7/0077* (2013.01); *A45C 7/0095* (2013.01);
(Continued)

(58) Field of Classification Search
CPC ..... A45C 3/001; A45C 3/00; A45C 7/0095; A45C 7/0077; A45C 7/0036;
(Continued)

(56) References Cited

U.S. PATENT DOCUMENTS 4,588,056 A 5/1986 Bernbaum
4,629,040 A * 12/1986 Jones ..... A45C 13/36 190/122
(Continued)

FOREIGN PATENT DOCUMENTS

CN 202603887 U 12/2012
CN 204105120 U 1/2015
(Continued)

OTHER PUBLICATIONS

Preferred Nation P9026 20 Folding Luggage 20 x 14 x 8; http://www.preferrednation.com/main/default/p-946-P9026_20_Folding_Luggage.aspx; 3 pgs.

*Primary Examiner* — Gideon R Weinerth
(74) *Attorney, Agent, or Firm* — Lowe Graham Jones PLLC

(57) ABSTRACT

A collapsible travel case includes a plurality of panels that are each non-removably secured to at least one other panel of the plurality of panels. Each panel of a subset of the panels may be removably secured to another panel of the subset of panels such that the plurality of panels define a substantially cuboid shape. A top panel may define a top opening with a closure mechanism. A bottom panel may be foldable and insertable within the top opening with other panels of the plurality of panels folded between the top panel and the bottom panel. The bottom panel may include a retractable stiffening element. Panels may define openings through which flaps secured to other panels may insert and be secured within using fastening material.

16 Claims, 11 Drawing Sheets

(51) Int. Cl.
*A45C 3/00* (2006.01)
*B65D 33/02* (2006.01)

(52) U.S. Cl.
CPC ..... *A45C 7/0036* (2013.01); *A45C 2003/008* (2013.01); *A45C 2007/0004* (2013.01)

(58) Field of Classification Search
CPC ..... A45C 7/0054; A45C 9/00; A45C 11/24; A45C 13/36; A45C 2003/008; A45C 2005/035; A45C 2007/0004; A45C 2013/026; A45C 2007/0013; A45C 13/02; B65D 5/2095; B65D 5/24; B65D 5/22; B65D 5/241; B65D 5/243; B65D 5/245; B65D 5/24736; B65D 2501/24184; B65D 37/00; B65D 1/225; B65D 81/3858; B65D 21/086
USPC ..... 150/129, 130, 108; 190/107, 110, 127, 190/902, 24, 903, 115; 206/459.5, 577, 206/581, 810; 220/6, 666, 8, 4.08, 4.28; 383/119, 104, 111, 4, 97
See application file for complete search history.

(56) References Cited

U.S. PATENT DOCUMENTS 4,951,818 A * 8/1990 Johnson ..... A45C 13/36 190/127
4,984,906 A * 1/1991 Little ..... A45C 9/00 383/110
5,086,888 A * 2/1992 Chu ..... A45C 7/0036 190/114
5,857,778 A * 1/1999 Ells ..... B65D 81/3858 383/110
5,868,306 A * 2/1999 Wen-Tsan ..... B65D 25/205 229/120.07
5,904,230 A * 5/1999 Peterson ..... A45C 11/20 383/4
6,048,099 A * 4/2000 Muffett ..... A45C 11/20 383/110
6,074,093 A * 6/2000 Anderson ..... B65D 5/4295 383/110
6,220,473 B1 4/2001 Ehman et al.
6,681,936 B2 * 1/2004 Godshaw ..... A45C 5/005 190/113
7,044,277 B2 * 5/2006 Redzisz ..... A45C 7/0095 190/107
7,163,340 B2 * 1/2007 Godshaw ..... B25H 3/00 383/41
8,066,118 B1 * 11/2011 Van Tassell ..... B65D 83/0894 224/932
8,177,431 B2 * 5/2012 Turvey ..... B65D 37/00 383/117
9,706,821 B2 7/2017 Tseng et al.
10,188,184 B2 1/2019 Wong et al.
D888,548 S * 6/2020 Hietanen ..... B65D 25/205 D9/432
10,849,399 B2 * 12/2020 Schurman ..... A45C 7/0086
10,988,300 B1 * 4/2021 Lee ..... B65D 5/241
11,104,474 B1 * 8/2021 Kim ..... B65D 5/4212
2003/0010780 A1 * 1/2003 Redzisz ..... A45C 7/0095 220/6
2003/0221924 A1 * 12/2003 Tong ..... A45C 11/20 190/110
2005/0238261 A1 * 10/2005 Godshaw ..... A45C 7/0036 119/474
2006/0011686 A1 * 1/2006 Latham ..... B60R 7/04 190/102
2006/0037881 A1 * 2/2006 Redzisz ..... A45C 7/0036 206/349
2007/0025647 A1 * 2/2007 Hamlin ..... B25H 3/00 383/17
2007/0215425 A1 9/2007 Slater
2008/0142558 A1 * 6/2008 Dexter ..... B60R 7/02 190/110
2009/0145711 A1 * 6/2009 Panosian ..... A45C 7/0086 383/42
2010/0089778 A1 * 4/2010 Park ..... A45C 7/0095 206/320
2013/0264363 A1 * 10/2013 Ballou ..... B65D 25/04 224/42.32
2014/0169705 A1 * 6/2014 Schinasi ..... B65D 33/02 383/119
2016/0242519 A1 * 8/2016 Calman ..... A45C 9/00
2017/0202325 A1 * 7/2017 Hodgson ..... A45C 13/103
2019/0092525 A1 * 3/2019 Sawachi ..... B65D 25/2841
2021/0227787 A1 * 7/2021 Friedgood ..... A45C 13/02
2021/0235828 A1 * 8/2021 Yeh ..... A45C 7/0077
2021/0361043 A1 * 11/2021 Wood ..... A45C 7/0095
2022/0316842 A1 * 10/2022 Thompson ..... F41H 1/02
2023/0070663 A1 * 3/2023 Yakay ..... A47B 43/04

FOREIGN PATENT DOCUMENTS

EP 0542821 B1 4/1996
KR 200323165 Y1 8/2003
KR 20120119230 A 10/2012
KR 200479056 Y1 12/2015
WO 2020031173 A1 2/2020

* cited by examiner

COLLAPSIBLE TRAVEL CASE

PRIORITY CLAIM

This application claims the benefit of U.S. Provisional Application Ser. No. 63/029,113 filed May 22, 2020, and entitled COLLAPSIBLE BOX, which is hereby incorporated herein by reference in its entirety.

FIELD OF THE INVENTION

This application relates to travel cases.

BACKGROUND OF THE INVENTION

Travel cases are often used to carry items while traveling. Quality cases may be quite useful. However, the amount of time an individual spends traveling with gear in the case is often quite small relative to the time spent at home or at a destination. At those times, the travel case is bulky and unneeded. It would be an advantage in the art to reduce the bulk and inconvenience of travel cases when not in use. Reduction in bulk would also help reduce shipping costs for new cases.

SUMMARY OF THE INVENTION

In one aspect of the invention, a collapsible travel case includes a plurality of panels including a front panel, a top panel, a back panel, a bottom panel, a left panel, and a right panel. Each panel of the plurality of panels may be non-removably secured to at least one other panel of the plurality of panels. Each panel of a subset of the panels may be removably secured to another panel of the subset of panels such that the plurality of panels define a substantially cuboid shape. The subset of panels may include the front panel, back panel, bottom panel, left panel, and right panel. The top panel may define a top opening with a closure mechanism. The bottom panel may be foldable and insertable within the top opening with each of the front panel, left panel, and right panel folded across the top panel and positioned between the back panel and the top panel. The closure mechanism may include a zipper. The zipper may include two zipper pulls configured to allow the closure mechanism to partially close the top opening around the bottom panel when the bottom panel is inserted through the top opening.

The bottom panel may include a stiffening panel and a bottom opening, the stiffening panel being removable from the bottom panel through the bottom opening. The bottom panel may have a first bottom edge secured to the back panel and a second bottom edge opposite the first bottom edge that is not non-removably attached to any panel of the plurality of panels, the second bottom edge being insertable through the top opening, the bottom opening being closer to the first bottom edge than to the second bottom edge.

In some embodiments, a first panel of the subset of panels includes a first panel including an inner layer and an outer layer, first fastening material positioned between the inner layer and the outer layer at a first edge of the first panel, and second fastening material positioned between the inner layer and the outer layer at a second edge of the first panel opposite the first edge. A second panel of the subset of panels may define a second panel flap positionable between the inner layer and the outer layer in engagement with the first fastening material. A third panel of the subset of panels may define a third panel flap positionable between the inner layer and the outer layer in engagement with the second fastening material.

In some embodiments: the top panel is non-removably secured at a first top edge of the top panel to a first front edge of the front panel; the back panel is non-removably secured at a first back edge of the back panel to a second top edge of the front panel, the second top edge being on an opposite side of the top panel from the first top edge; the bottom panel is non-removably secures at a first bottom edge of the bottom panel to a second back edge of the back panel; the left panel is non-removably secured at a first left edge of the left panel to a third top edge of the top panel extending between the first top edge and the second top edge; and the right panel is non-removably secured to a first right edge of the right panel to a fourth top edge of the top panel extending between the first top edge and the second top edge and positioned opposite the third edge.

In some embodiments, the bottom panel includes: a second bottom edge selectively securable to a second front edge of the front panel opposite the first front edge; a third bottom edge selectively securable to a second left edge of the left panel opposite the first left edge; and a fourth bottom edge selectively securable to a second right edge of the right panel opposite the first right edge.

In some embodiments, the bottom panel includes: a first bottom flap secured along the second bottom edge and including first fastening material; a second bottom flap secured along the third bottom edge and including second fastening material; a third bottom flap secured along the fourth bottom edge and including third fastening material; the front panel includes fourth fastening material positioned to engage the first fastening material; the left panel includes fifth fastening material positioned to engage the second fastening material; and the right panel includes sixth fastening material positioned to engage the third fastening material.

In some embodiments, the front panel includes a first front flap secured to a third front edge of the front panel extending between the first front edge and the second front edge and a second front flap secured to a fourth front edge of the front panel opposite the third front edge. The back panel may include a first back flap secured to a third back edge of the back panel extending between the first back edge and the second back edge and a second back flap secured to a fourth front edge of the back panel opposite the third back edge. The left panel may include a first left opening along a third left edge of the left panel and a second left opening extending along a fourth left edge of the left panel opposite the third left edge, the third left edge and fourth left edge of the panel extending between the first left edge and the second left edge. The right panel may include a first right opening along a third right edge of the right panel and a second right opening extending along a fourth right edge of the right panel opposite the third right edge, the third right edge and fourth right edge of the panel extending between the first right edge and the second right edge. The first front flap may be selectively securable within the first left opening and the second front flap is selectively securable within the first right opening. The first back flap may be selectively securable within the second left opening and the second back flap is selectively securable within the second right opening In some embodiments, the front panel includes first fastening material on an inner surface thereof; the back panel incudes second fastening material on an inner surface thereof; and the collapsible travel case further includes a divider including third fastening material configured to engage the first fastening material and fourth fastening material configured to engage the second fastening material such that the divider subdivides a volume defined by the cuboid shape.

In some embodiments, a collapsible travel case includes: a front panel; a top panel secured at a first top edge of the top panel to a first front edge of the front panel; a back panel secured at a first back edge of the back panel to a second top edge of the front panel, the second top edge being on an opposite side of the top panel from the first top edge; a bottom panel secured at a first bottom edge of the bottom panel to a second back edge of the back panel; a left panel secured at a first left edge of the left panel to a third top edge of the top panel extending between the first top edge and the second top edge; a right panel secured to a first right edge of the right panel to a fourth top edge of the top panel extending between the first top edge and the second top edge and positioned opposite the third edge; wherein the bottom panel includes: a second bottom edge selectively securable to a second front edge of the front panel opposite the first front edge; a third bottom edge selectively securable to a second left edge of the left panel opposite the first left edge; and a fourth bottom edge selectively securable to a second right edge of the right panel opposite the first right edge; wherein the front panel includes a first front flap secured to a third front edge of the front panel extending between the first front edge and the second front edge and a second front flap secured to a fourth front edge of the front panel opposite the third front edge; wherein the back panel includes a first back flap secured to a third back edge of the back panel extending between the first back edge and the second back edge and a second back flap secured to a fourth front edge of the back panel opposite the third back edge; wherein the left panel includes a first left opening along a third left edge of the left panel and a second left opening extending along a fourth left edge of the left panel opposite the third left edge, the third left edge and fourth left edge of the panel extending between the first left edge and the second left edge; wherein the right panel includes a first right opening along a third right edge of the right panel and a second right opening extending along a fourth right edge of the right panel opposite the third right edge, the third right edge and fourth right edge of the panel extending between the first right edge and the second right edge; wherein the first front flap is selectively securable within the first left opening and the second front flap is selectively securable within the first right opening; and wherein the first back flap is selectively securable within the second left opening and the second back flap is selectively securable within the second right opening.

In some embodiments, the first left opening and the second left opening are defined between an inner left layer and an outer left layer of the left panel and the first right opening and second right opening are defined between an inner right layer and an outer right layer of the right panel.

In some embodiments, first left fastening material is secured between the inner left layer and the outer left layer and positioned to engage the first front flap; second left fastening material is secured between the inner left layer and the outer left layer and positioned to engage the first back flap; first right fastening material is secured between the inner right layer and the outer right layer and positioned to engage the second front flap; and second right fastening material is secured between the inner left layer and the outer left layer and positioned to engage the second back flap.

In some embodiments, the first left fastening material, second left fastening material, first right fastening material, and second right fastening material are hook-and-loop fastening material.

In some embodiments, the top panel defines a top opening with a closure mechanism and the bottom panel is foldable and insertable within the top opening with each of the front panel, left panel, and right panel folded across the top panel and positioned between the back panel and the top panel.

In some embodiments, the closure mechanism is a zipper extending continuously along the third top edge, the first top edge, and the fourth top edge. The zipper may include two zipper pulls configured to allow the closure mechanism to close the top opening along the third edge and the fourth edge when the bottom panel is inserted through the top opening.

In some embodiments, the bottom panel includes a stiffening panel and a bottom opening, the stiffening panel being removable from the bottom panel through the bottom opening to enable folding of the bottom panel. The bottom opening is closer to the first bottom edge than to the second bottom edge.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
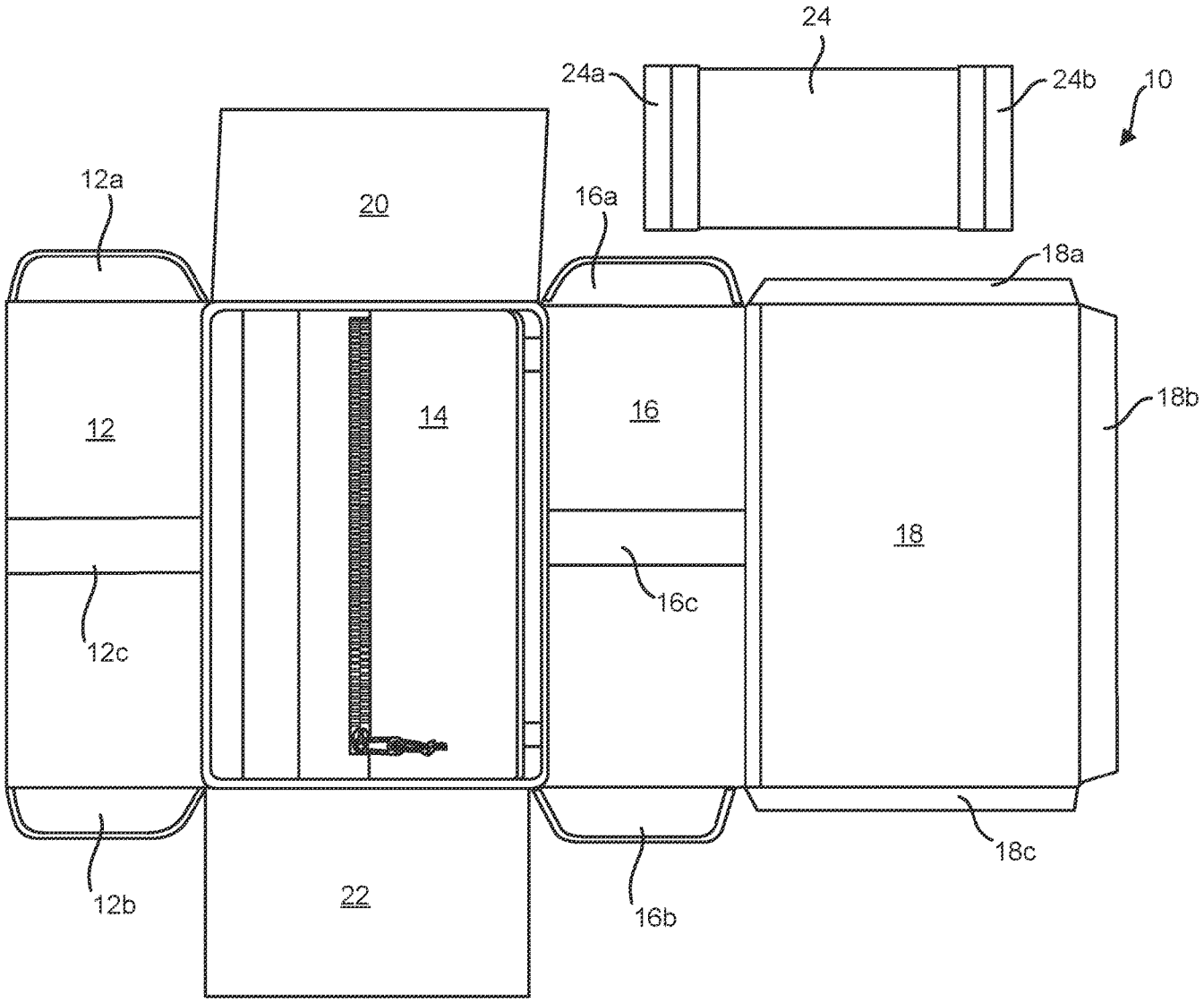
FIG. 1 is an inner view of an disassembled collapsible travel case in accordance with an embodiment of the present invention.

FIG. 1 illustrates an inner surface of a disassembled collapsible travel case. The collapsible travel case 10 may include a front panel 12, a top panel 14, a back panel 16, a bottom panel 18, a left panel 20, and a right panel 22. The designations as front, top, back, bottom, left, and right are used to indicate positions relative to one another to facilitate understanding of the collapsible travel case but need not correspond to the actual position of these panels in use.

Each panel 12, 14, 16, 18, 20, 22 may be quadrilateral in shape. The panels 12, 14, 16, 18, 20, 22 may be made of one or more layers of fabric and incorporate one or more layers of stiffening material (rigid plastic and/or foam). The fabric, rigid, plastic, and/or foam may be according to any such materials used in the field of travel cases. In particular, an outer layer of fabric may be a tough material, such as a woven nylon having a high denier and an inner layer of fabric may be a soft and low-friction material. In some embodiments, the outer layer is coated nylon with the thickness of the coating increasing for high-wear applications. In some embodiments, the panels 12 include a nylon outer layer with a backing laminate. For heavy duty applications, coated nylon may also be used for the inner layer.

Accordingly, the shape of the panels 12, 14, 16, 18, 20, 22 may be malleable and vary at least slightly according to applied forces. Accordingly, "quadrilateral" as applied to a panel shall be understood to mean: with the panel laid on a flat surface in the absence of a force acting on the panel, the panel has a perimeter such that a rectangle parallel to the flat surface may be defined such that 80 percent of the perimeter is within a threshold distance from the rectangle, the threshold distance being a value that is less than 5 percent of a longest dimension of the rectangle. In the foregoing discussion, reference is made to edges of panels 12, 14, 16, 18, 20, 22. An edge of a panel may be understood as a length of the perimeter of a panel of which at least 80 percent lies within the threshold distance from an edge of the rectangle defined as described above.

The front panel 12 is secured along one edge to a first edge of the top panel 14. A second edge of the top panel 14 opposite the first edge of the back panel is secured to a first edge of the back panel 16. A second edge of the back panel 16 opposite the first edge of the back panel 16 is secured to an edge of the bottom panel 18.

One edge of the left panel 20 is secured to a left edge of the top panel 14, the left edge extending between the first edge and the second edge of the top panel 14. One edge of the right panel 22 is secured to a right edge of the top panel 14, the right edge extending between the first edge and the second edge of the top panel 14 and being on an opposite side of the top panel 14 from the right edge.

The front panel 12 may include flaps 12*a*, 12*b* connected to left and right edges, respectively of the front panel 12, the left and right edges extending substantially (e.g., within 10 percent of) perpendicular to the edge of front panel 12 secured to the top panel 14. The back panel 16 may include flaps 16*a*, 16*b* connected to left and right edges, respectively of the back panel 16, the left and right edges extending substantially (e.g., within 10 percent of) perpendicular to the first edge of back panel 12 secured to the top panel 14. The flaps 12*a*, 12*b*, 16*a*, 16*b* may have lengths substantially smaller, e.g. less than 20 percent of the lengths of the panels 12, 16 between the right and left edges thereof. The flaps 12*a*, 12*b*, 16*a*, 16*b* are preferably flexible and may lack stiffening elements present in the panels 12, 16. The flaps 12*a*, 12*b*, 16*a*, 16*b* may be tapered or rounded with distance from the panels 12, 16 in order to facilitate insertion within the left and right panels 20, 22 as described below.

The collapsible travel case 10 may be used with a divider 24. The divider 24 may be used to divide a compartment defined within the travel case 10 into two sub compartments. The divider 24 may include fastener portions 24*a*, 24*b* extending from its left and right edges, the fastener portions 24*a*, 24*b* may be flaps with fastening material on at least one side. As used herein, "fastening material" shall be understood to be either an area of hooks or loops according to a hook-and-loop fastening system (e.g., VELCRO), an area of 3M DUAL LOCK material, a set of snap fasteners, or other fastening system. References herein to first fastening material engaging second fastening material shall be understood to include the first fastening material being of a first type (e.g., hooks) and the second being of a second type configured to engage with the second type (e.g., loops) where hook-and-loop fastening material is used.

The front panel 12 may include fastening material 12*c* and the rear panel 16 may include fastening material 16*c*. The fastener portions 24*a*, 24*b* may therefore be engaged with the fastening material 12*c*, 16*c*, respectively, on order to secure the divider 24 within the collapsible travel case 10.

Figure 2:
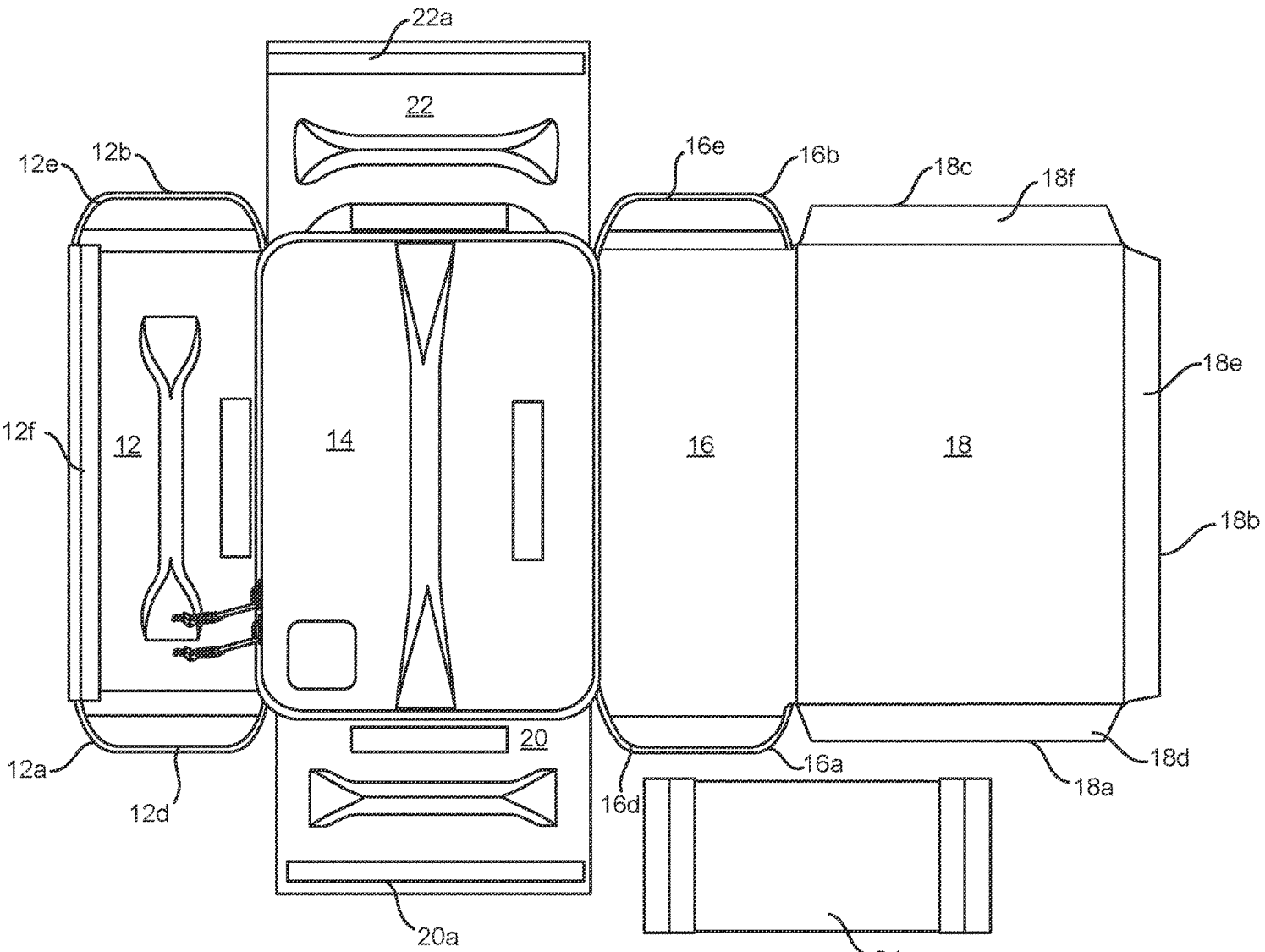
FIG. 2 is an outer view of the disassembled collapsible travel case in accordance with an embodiment of the present invention.

FIG. 2 illustrates an outer surface of the disassembled collapsible travel case 10. The outer surfaces of the panels 12, 14, 16, 18, 20, and 22 may form the exterior of the collapsible case when assembled. As is apparent in FIG. 2, one or more of the panels 12, 14, 20, and 22 may have handles formed thereon. Other features such as labels, clear pockets for identification information, or other features commonly incorporated into luggage may also be present on one or more of the panels 12, 14, 16, 18, 20, and 22.

Various areas of fastening material may be secured to the panels 12, 16, 18, 20, and 22 in order to facilitate assembling of the collapsible travel case. In the illustrated implementation this includes fastening material 12*d* on the bottom surface of flap 12*a*, fastening material 12*e* on the bottom of flap 12*b*, fastening material 16*d* on the lower surface of flap 16*a*, and fastening material 16*e* on the lower surface of flap 16*b*. As is apparent, substantially all (e.g., between 70 and 100 percent) of the lower surfaces of the flaps 12*a*, 12*b*, 16*a*, 16*b* are covered with the fastening material.

Fastening material 20*a* may be secured to a bottom surface of panel 20 and fastening material 22*a* may be secured to a bottom surface panel 22. Additional fastening material 12*f* may be secured along an edge of panel 12 opposite the edge of panel 12 fastened to the top panel 14. As is apparent, the fastening material 20*a*, 22*a*, 12*f* does not cover even a major portion of the panels 20, 22, 12 in the illustrated embodiment. For example, the fastening material 20*a*, 22*a*, 12*f* may be a strip having a width of 3 to 7 cm at a distal edge of the panels 20, 22, 12 opposite the edge of these panels secured to the top panel 14. The length of the fastening material 20*a*, 22*a*, 12*f* may be substantially (up to −10%) equal to the width of the panels 20, 22, 12 to which the fastening material 20*a*, 22*a*, 12*f* secures parallel to the edge of the panels 20, 22, 12 secured to the top panel 14.

The bottom panel 18 may include fastening material 18*d*, 18*e*, 18*f* on the flaps 18*a*, 18*b*, 18*c*, respectively. The fastening material may cover substantially all (e.g., between 70 and 100 percent) of the bottom surfaces of the flaps 18*a*, 18*b*, 18*c*.

When assembled, fastening material 18*d* engages fastening material 20*a*, fastening material 18*e* engages fastening material 12*f*, and fastening material 18*f* engages fastening material 22*a*. As discussed in greater detail below, flaps 12*a* and 16*a* may be tucked into pockets in the right panel 20 and flaps 12*b* and 16*b* may be tucked into pockets in the left panel 22. These pockets may include fastening material engaging the fastening material 12*d*, 12*e*, 16*d*, and 16*e*.

Figure 3:
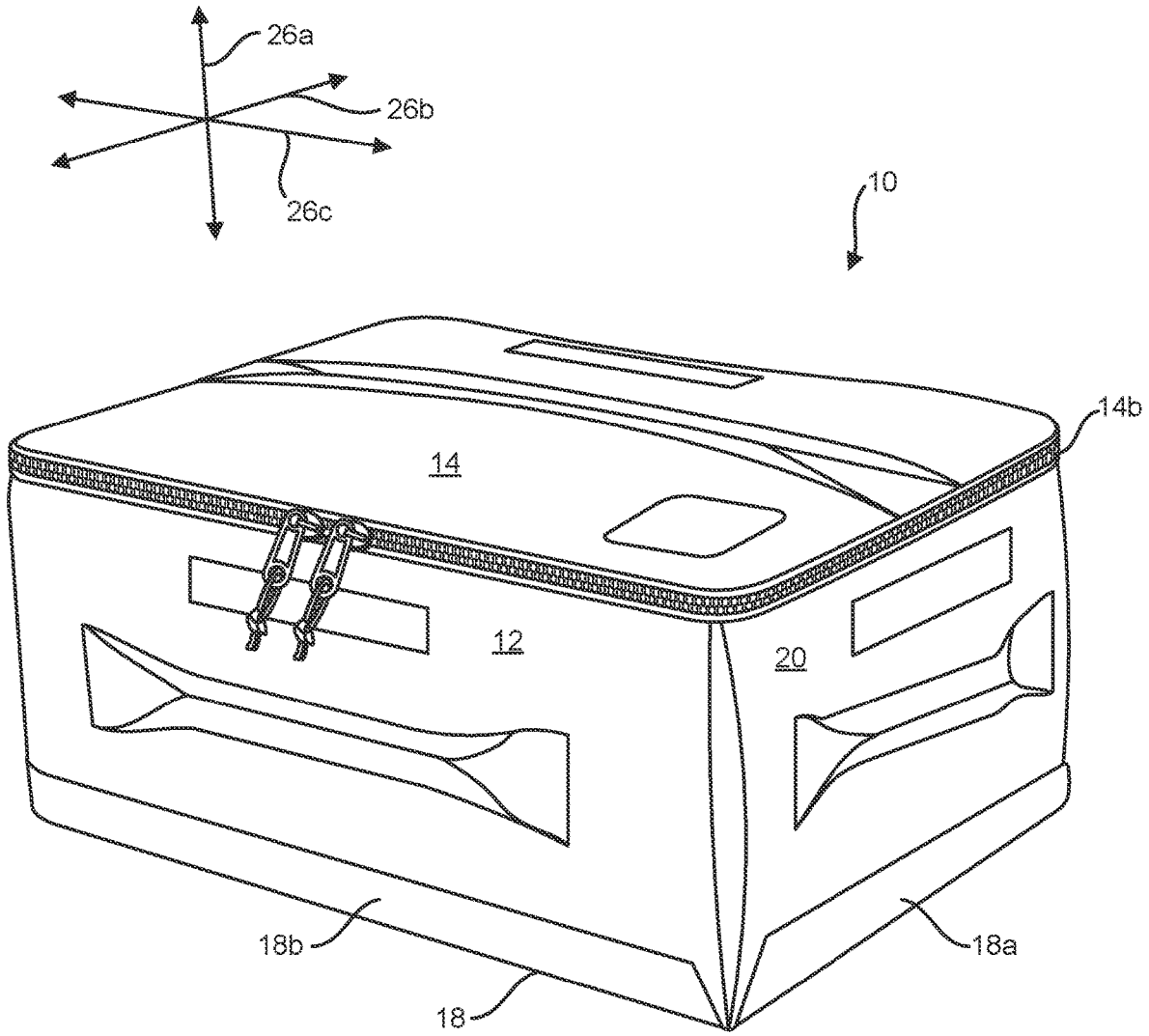
FIG. 3 is an isometric view the an assembled collapsible travel case in accordance with an embodiment of the present invention.

FIG. 3 illustrates the collapsible travel case 10 when assembled. The collapsible travel case 10 may define a substantially cuboid shape with respect to a vertical direction 26*a*, a longitudinal direction 26*b*, and a transverse direction 26*c* that are all perpendicular to one another.

When assembled, the top panel 14 may lie substantially within a first plane parallel to the longitudinal direction 26*b* and the horizontal direction 12*c*. As used herein "substantially within" a plane shall be understood as 80 percent of a panel lying within 1 cm of the plane. The bottom panel 18 may lie substantially within a second plane parallel to the first plane and offset along the vertical direction 26*a*. The front panel 12 may lie substantially within a third plane parallel to the vertical direction 26*a* and the transverse direction 26*c*. The back panel 16 may lie substantially within a fourth plane parallel to the third plane and offset therefrom along the longitudinal direction 12*b*. The right panel 20 may lie substantially within a fifth plane parallel to the vertical direction 26*a* and the longitudinal direction 26*b*. The left panel 22 may lie substantially within a sixth plane parallel to the fifth plane and offset therefrom along the transverse direction 12*c*.

As is apparent, the width of the case 10 in the transverse direction 12*c* is greater than the depth of the case in the longitudinal direction 12*b*. The depth of the case may be greater than a height of the case 10 in the vertical direction 12*a*. These dimensions are exemplary only and other configurations are also possible.

Figure 4:
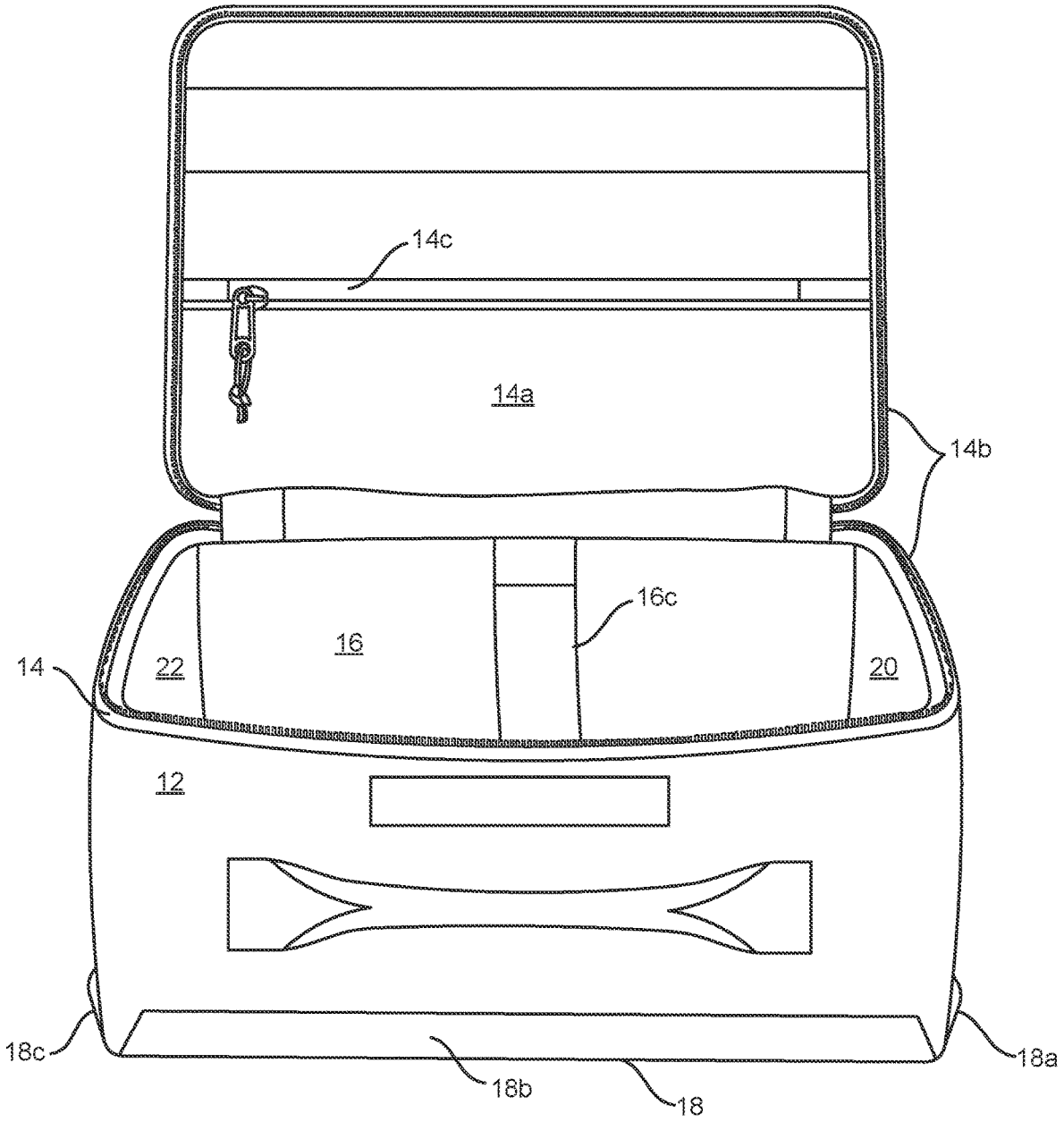
FIG. 4 is an isometric view of the assembled collapsible travel case with a lid open in accordance with an embodiment of the present invention.

FIGS. 3 and 4 further show that the top panel 14 may include a lid 14*a* that is secured to the top panel 14 by means of a zipper 14*b* or other closure mechanism. In the illustrated example, the top panel 14 is non-removably secured to the back panel 16 and the zipper extends around the lid 14 at or slightly inward (e.g., 1-2 cm) from the perimeter of the top panel 14 along the front edge secured to the front panel 12, the right edge secured to the right panel 20, and the left edge secured to the left panel 22. One or more pockets 14*c* or other storage features may be formed on an inner surface of the lid.

Figure 5:
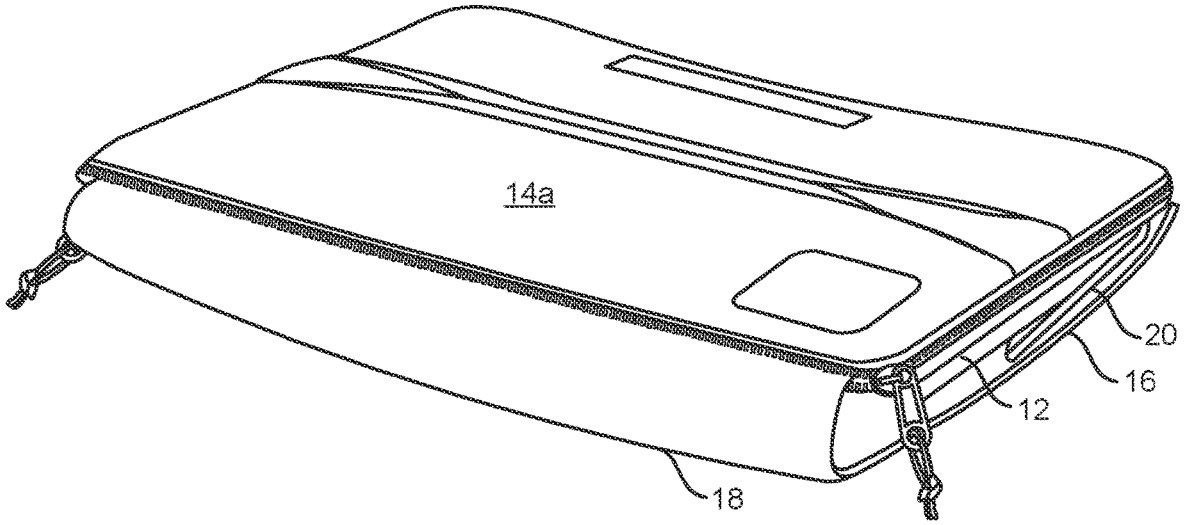
FIGS. 5 and 6 are isometric views of a folded collapsible travel case in accordance with an embodiment of the present invention.
Figure 6:
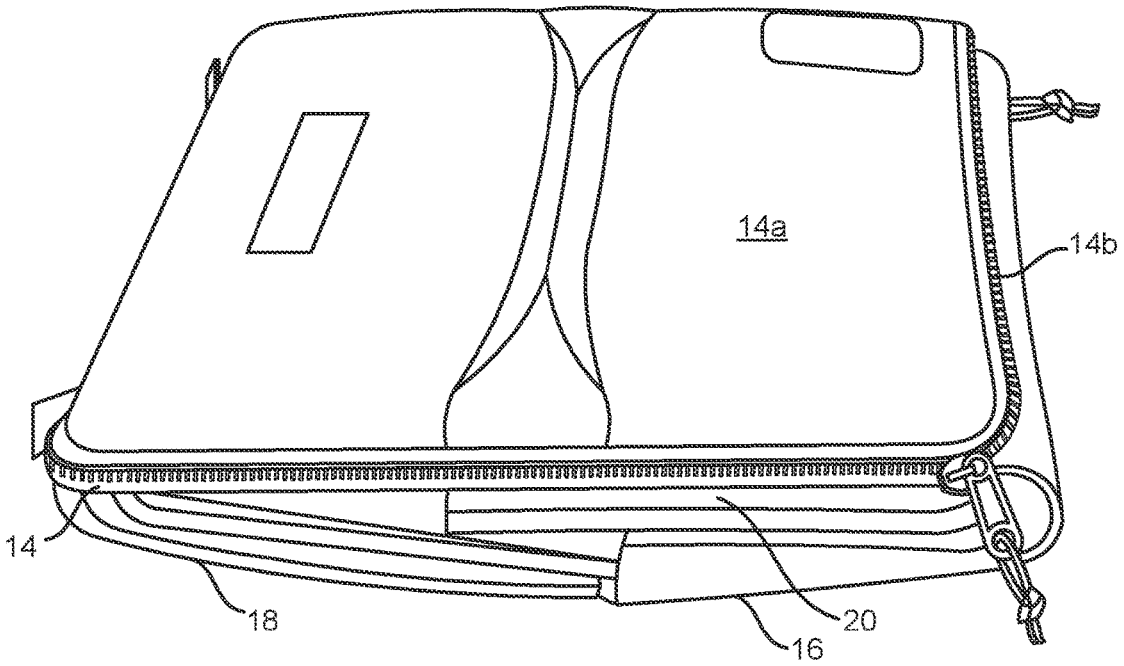

FIGS. 5 and 6 illustrate the collapsible travel case 10 when both collapsed and folded into a compact configuration. In folded configuration, the front panel 12, right panel 20, and left panel 22 are folded over the top panel 14. The zipper 14*b* is opened along the edge connecting the top panel 14 to the front panel 12 and the bottom panel 18 may be folded under the top panel 14 with the front panel 12, right panel 20, and left panel 22 positioned between a portion of the bottom panel 18 on one side and the top panel 14 one the other side. At least part of the bottom panel 18 may be inserted through the open portion of the zipper 14*b* as shown in FIGS. 5 and 6. As is apparent from the configuration of FIGS. 2 and 3, the back panel 16 will also be positioned under the top panel 14 with the front panel 12, right panel 20, and left panel 22 positioned between the back panel 16 and the top panel 14 when a portion of the bottom panel 18 is inserted through the opening in the zipper 14*b*. The zipper 14*b* may be closed along the edges connected to the panels 20 and 22 as shown in FIGS. 5 and 6 in order to resist removal of the bottom panel 18. The zipper 14*b* may therefore be provided with two zipper pulls as shown.

FIGS. 7 through 12 illustrate an approach for transitioning the collapsible travel case 10 from the collapsed and folded configuration of FIGS. 5 and 6 to the assembled configuration of FIG. 3.

Figure 7:
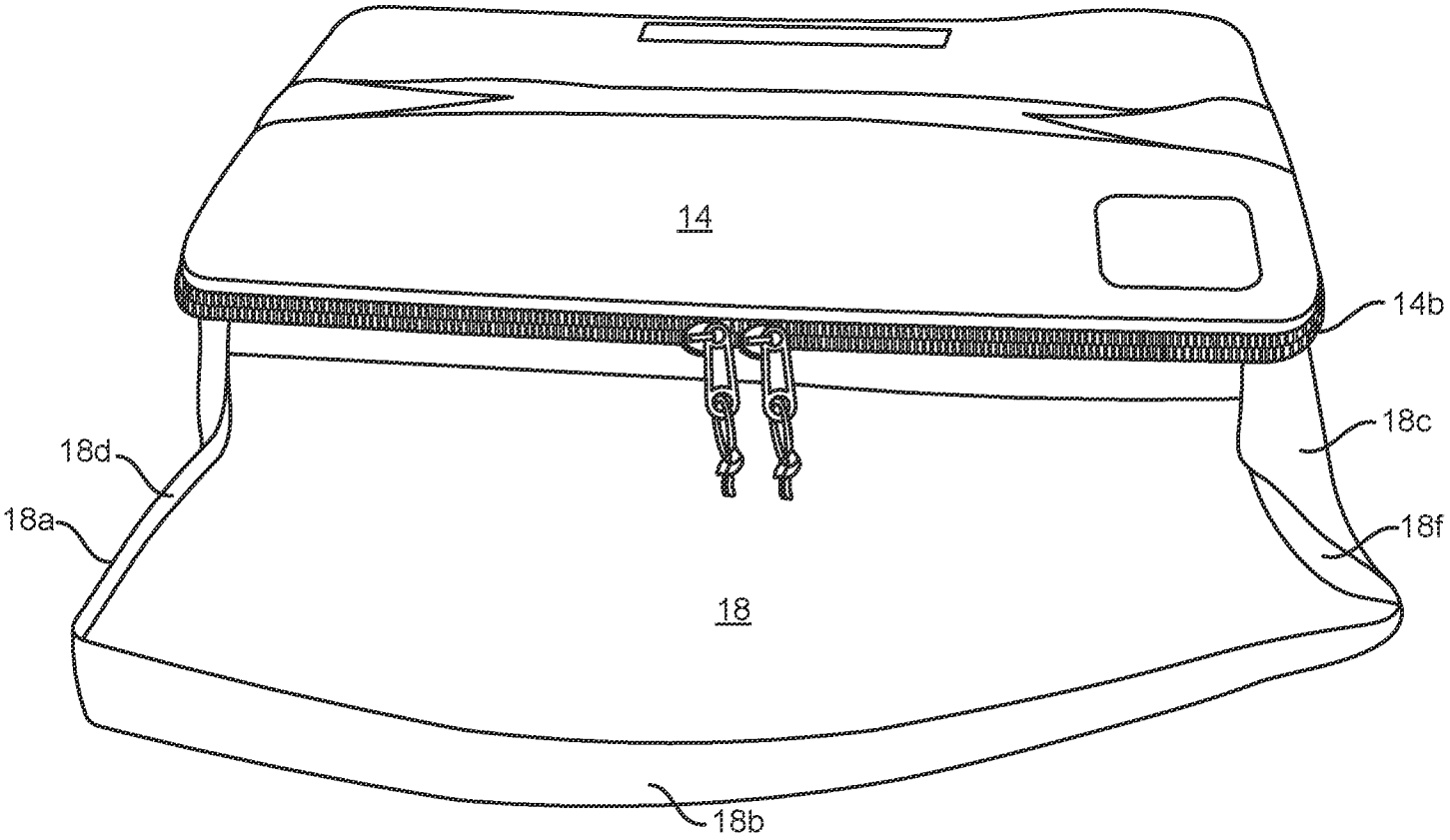
FIG. 7 is an isometric view illustrating folding out of a bottom panel of the folded collapsible travel case in accordance with an embodiment of the present invention.
Figure 8:
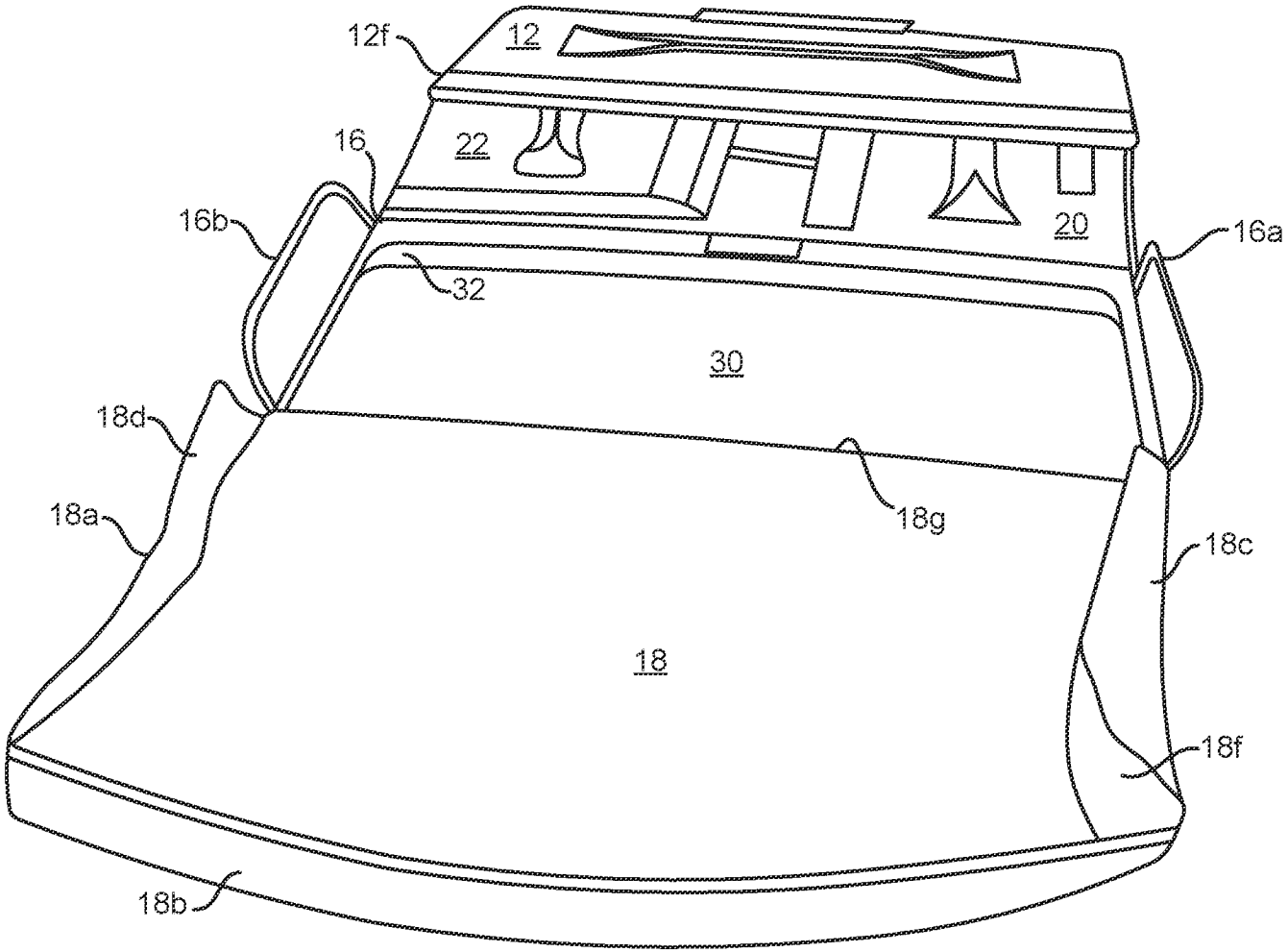
FIG. 8 is an isometric view illustrating the position of stiffening members of a bottom panel suitable for folding in accordance with an embodiment of the present invention.

Referring specifically to FIG. 7, the portion of the bottom panel 18 inserted through the zipper 14*b* may be withdrawn. Referring to FIG. 8, the top panel 14 may be folded out and away from the bottom panel 18 and back panel 16, exposing the front panel 12, right panel 20, left panel 22, and back panel 16.

As noted above, the panels may be reinforced by one or both of rigid plastic and foam. In the illustrated embodiment, the bottom panel 18 is reinforced by both a rigid plastic plate 30 and a foam pad 32. In order to fold the bottom panel 18 through the opening in the zipper 14*b*, the plate 30 and foam pad 32 may be partially pulled out from the bottom panel 18, such as through an opening 18*g* defined by the bottom panel 18. Accordingly, in the folded configuration, the plate 30 and foam pad 32 extends partially or completely over the back panel 16.

Figure 9:
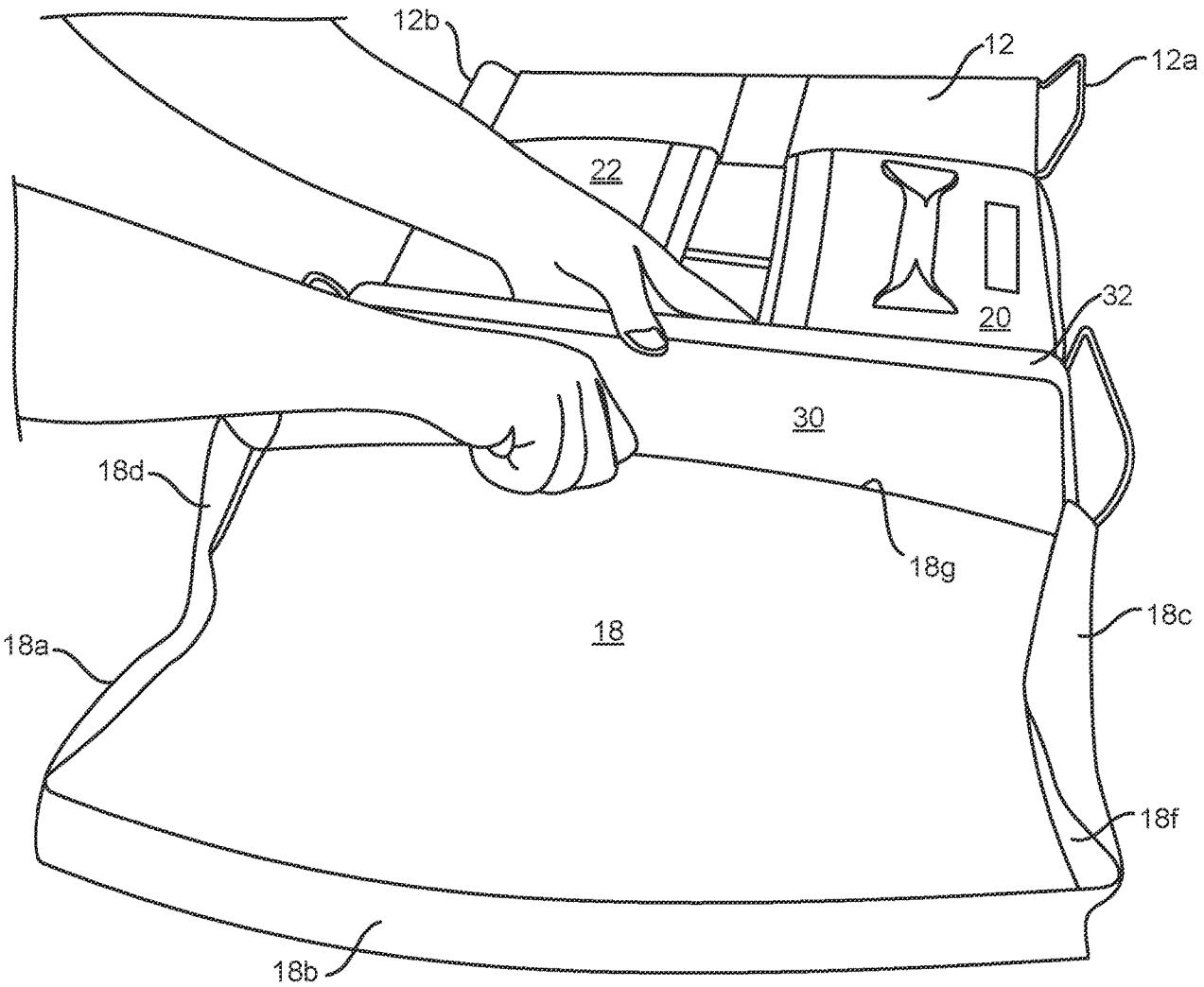
FIG. 9 is an isometric view illustrating repositioning of the stiffening members within the bottom panel suitable for assembling the collapsible travel case in accordance with an embodiment of the present invention.

As shown in FIG. 9, when transitioning to the assembled configuration, the plate 30 and pad 32 may be reinserted through the opening 18*g* such that the plate 30 and pad 32 no longer extend over the back panel 16.

Figure 10:
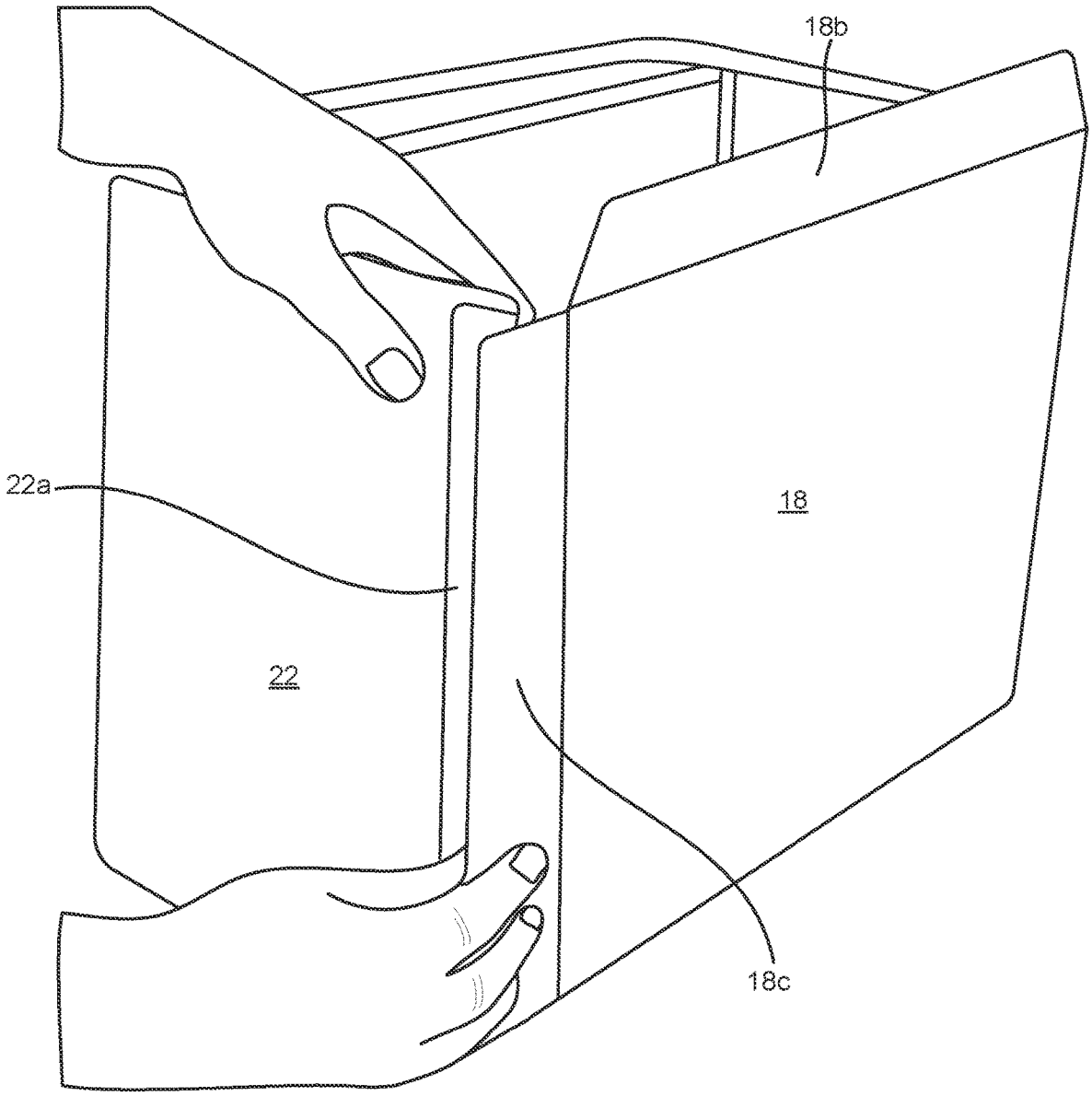
FIG. 10 is an isometric view illustrating assembly of the collapsible travel case with respect to the bottom panel in accordance with an embodiment of the present invention.

Referring to FIG. 10, transitioning to the assembled configuration may further include folding the front panel 12, back panel 16, right panel 20, and left panel 22 away from the top panel 14 (such as shown in FIG. 1). Assembly may include engaging fastening material 18*d* with fastening material 20*a*, engaging fastening material 18*e* with fastening material 12*f*, and engaging fastening material 18*f* with fastening material 22*a*. FIG. 10 shows flap 18*c* and its corresponding fastening material 18*f* engaged with fastening material 22*a* on left panel 22. The other flaps 18*a*, 118*b* may be engaged in a similar manner with panels 20 and 12.

Figure 11:
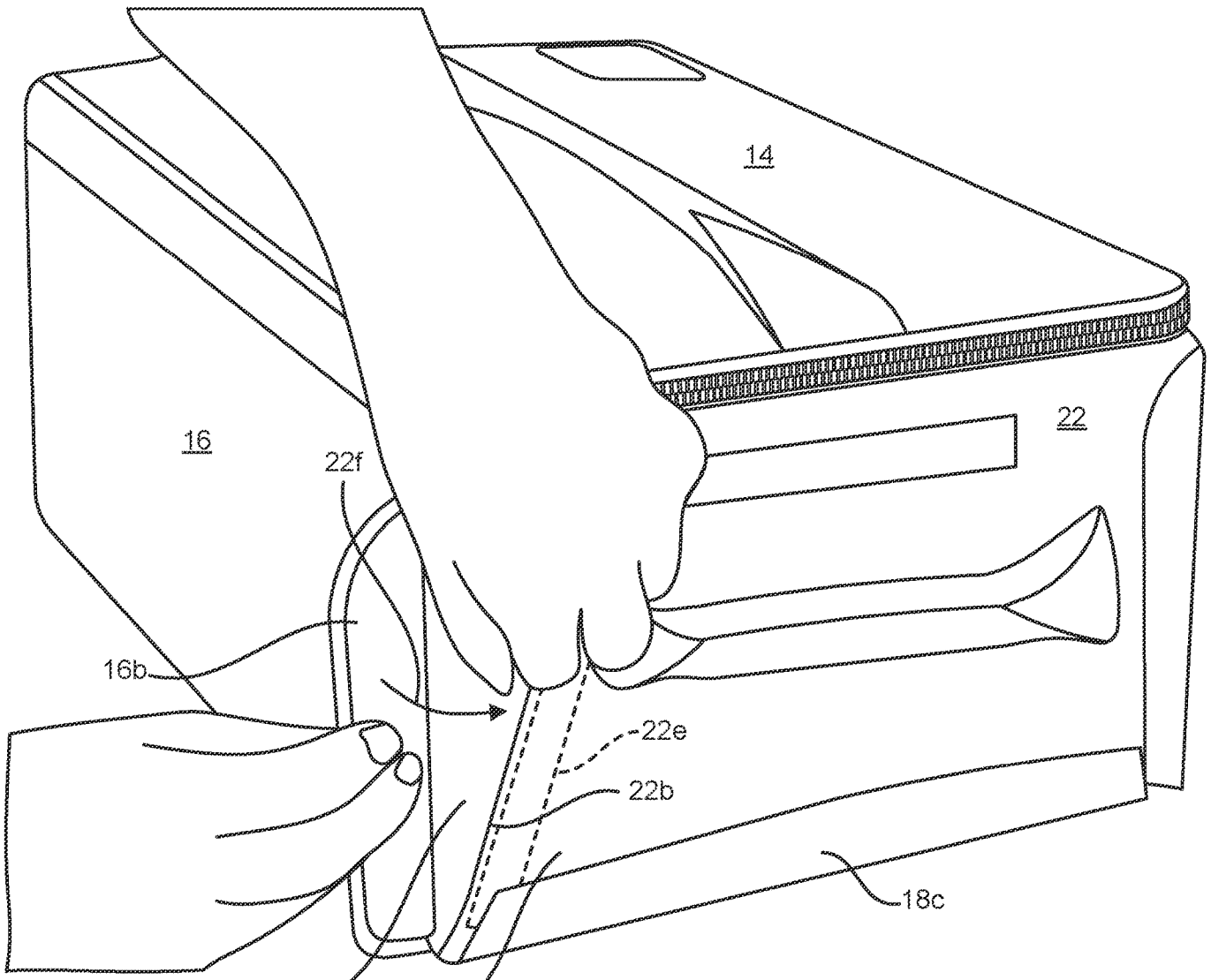
FIG. 11 is an isometric view illustrating securement of side panels to front and back panels of the collapsible case in accordance with an embodiment of the present invention.

FIG. 11 illustrates an example approach by which the flaps 12*a*, 12*b*, 16*a*, 16*b* may be engaged with the left and right panels 20, 22. For example, left panel 22 may define openings along its front and back edges, i.e., the edges located adjacent edges of the front and back panels 12, 16, respectively. The right panel 22 may also define similar openings along its front and back edges. An the openings may be defined between an inner layer and an outer layer of each panel 20, 22. Fastening material may be secured to the inner surface of the inner layer or outer layer next to the openings on the front and back edges.

FIG. 11 illustrates the back edge of the left panel 22 defining an opening 22*b* between an inner layer 22*c* and an outer layer 22*d* of the left panel 22. Fastening material 22*e* may be fastened to an inner surface of the outer layer 22*d* of panel 22. Accordingly, flap 16*b* may be inserted through the opening 22*b* as shown by arrow 22*f*. The fastening material 22*c* may then be pressed against the fastening material 16*e* in order to retain the flap 16*b* within the left panel 22. The same approach may be used to secure the flap 16*a* to the right panel 20, the flap 12*a* to the right panel 20, and the flap 12*b* to the left panel 22.

Figure 12:
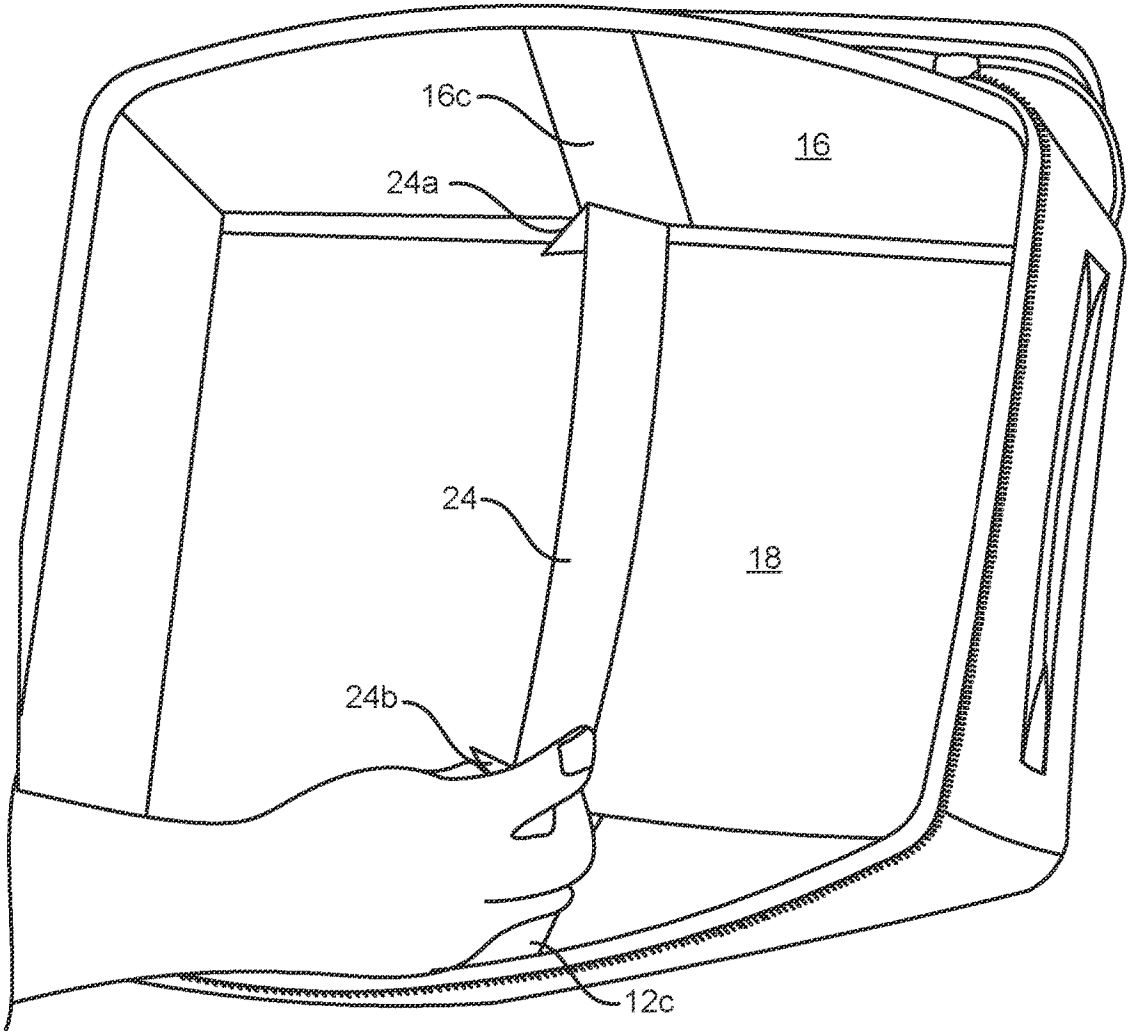
FIG. 12 is an isometric view illustrating positioning of an insert within the collapsible travel case in accordance with an embodiment of the present invention.

FIG. 12 illustrates an approach for securing the divider 24 within a compartment of the collapsible travel case 10 when in the assembled configuration. As is apparent, fastener portion 24*a* may be engaged with fastening material 16*c* and fastener portion 24*b* may be engaged with fastening material 12*c* in order to secure the divider 24 within the case 10.

Transitioning the collapsible case 10 to the collapsed and folded configuration may be performed in a reverse manner to the approach described above with respect to FIGS. 8 through 12. For example: divider 24 may be removed; flaps 12*a*, 12*b*, 16*a*, and 16*b* may be removed from openings in the right and left panels 20, 22, fastening material 18*d*, 18*e*, 18*f* may be disengaged; the plate 30 and pad 32 may be retracted as shown in FIG. 8; the panels 12, 20, and 22 may be folded over the top panel 14; the divider 24 may also be placed on the top panel 14; the bottom panel 18 and back panel 16 are wrapped over the panels 12, 20, 22 and possibly the divider 24 and inserted through an opening in the zipper 14*b* as shown in FIGS. 5 and 6. The zipper 14*b* may be closed along the edges connected to the panels 20 and 22 as shown in FIGS. 5 and 6 in order to resist removal of the bottom panel 18.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The invention claimed is:

1. A collapsible travel case comprising:

a plurality of panels including a front panel, a top panel, a back panel, a bottom panel, a left panel, and a right panel;

wherein each panel of the plurality of panels is non-removably secured to at least one other panel of the plurality of panels;

wherein each panel of a subset of the plurality of panels is removably secured to another panel of the subset of the plurality of panels such that the plurality of panels define a substantially cuboid shape, the subset including the front panel, back panel, bottom panel, left panel, and right panel;

wherein the top panel defines a top opening with a closure mechanism;

wherein the bottom panel is foldable and insertable within the top opening with each of the front panel, left panel, and right panel folded across the top panel and positioned between the back panel and the top panel; and wherein:

the top panel is non-removably secured at a first top edge of the top panel to a first front edge of the front panel;

the back panel is non-removably secured at a first back edge of the back panel to a second top edge of the top panel, the second top edge being on an opposite side of the top panel from the first top edge;

the bottom panel is non-removably secured at a first bottom edge of the bottom panel to a second back edge of the back panel;

the left panel is non-removably secured at a first left edge of the left panel to a third top edge of the top panel extending between the first top edge and the second top edge; and the right panel is non-removably secured at a first right edge of the right panel to a fourth top edge of the top panel extending between the first top edge and the second top edge and positioned opposite the third top edge;

wherein the bottom panel includes:

a second bottom edge selectively securable to a second front edge of the front panel opposite the first front edge;

a third bottom edge selectively securable to a second left edge of the left panel opposite the first left edge; and a fourth bottom edge selectively securable to a second right edge of the right panel opposite the first right edge.

wherein the bottom panel includes:

a first bottom flap secured along the second bottom edge and including first fastening material;

a second bottom flap secured along the third bottom edge and including second fastening material;

a third bottom flap secured along the fourth bottom edge and including third fastening material;

the front panel includes fourth fastening material positioned to engage the first fastening material;

the left panel includes fifth fastening material positioned to engage the second fastening material; and the right panel includes sixth fastening material positioned to engage the third fastening material;

wherein the front panel includes a first front flap secured to a third front edge of the front panel extending between the first front edge and the second front edge and a second front flap secured to a fourth front edge of the front panel opposite the third front edge;

wherein the back panel includes a first back flap secured to a third back edge of the back panel extending between the first back edge and the second back edge and a second back flap secured to a fourth front edge of the back panel opposite the third back edge;

wherein the left panel includes a first left opening along a third left edge of the left panel and a second left opening extending along a fourth left edge of the left panel opposite the third left edge, the third left edge and fourth left edge of the panel extending between the first left edge and the second left edge;

wherein the right panel includes a first right opening along a third right edge of the right panel and a second right opening extending along a fourth right edge of the right panel opposite the third right edge, the third right edge and fourth right edge of the panel extending between the first right edge and the second right edge;

wherein the first front flap is selectively securable within the first left opening and the second front flap is selectively securable within the first right opening; and wherein the first back flap is selectively securable within the second left opening and the second back flap is selectively securable within the second right opening.

2. The collapsible travel case of claim 1, wherein the closure mechanism is a zipper.

3. The collapsible travel case of claim 2, wherein the zipper includes two zipper pulls configured to allow the closure mechanism to partially close the top opening around the bottom panel when the bottom panel is inserted through the top opening.

4. The collapsible travel case of claim 1, wherein the bottom panel includes a stiffening panel and a bottom opening, the stiffening panel being removable from the bottom panel through the bottom opening.

5. The collapsible travel case of claim 4, wherein the bottom panel has a first bottom edge secured to the back panel and a second bottom edge opposite the first bottom edge that is not permanently attached to any panel of the plurality of panels, the second bottom edge being insertable through the top opening, the bottom opening being closer to the first bottom edge than to the second bottom edge.

6. The collapsible travel case of claim 1, wherein:

the front panel includes first fastening material on an inner surface thereof;

the back panel includes second fastening material on an inner surface thereof; and the collapsible travel case further comprises a divider including third fastening material configured to engage the first fastening material and fourth fastening material configured to engage the second fastening material such that the divider subdivides a volume defined by the substantially cuboid shape.

7. A collapsible travel case comprising:

a plurality of panels including a front panel, a top panel, a back panel, a bottom panel, a left panel, and a right panel;

wherein each panel of the plurality of panels is non-removably secured to at least one other panel of the plurality of panels;

wherein each panel of a subset of the plurality of panels is removably secured to another panel of the subset of the plurality of panels such that the plurality of panels define a substantially cuboid shape, the subset including the front panel, back panel, bottom panel, left panel, and right panel;

wherein the top panel defines a top opening with a closure mechanism;

wherein the bottom panel is foldable and insertable within the top opening with each of the front panel, left panel, and right panel folded across the top panel and positioned between the back panel and the top panel;

a first panel of the subset of the plurality of panels includes an inner layer and an outer layer, first fastening material positioned between the inner layer and the outer layer at a first edge of the first panel, and second fastening material positioned between the inner layer and the outer layer at a second edge of the first panel opposite the first edge;

a second panel of the subset of the plurality of panels defines a second panel flap positionable between the inner layer and the outer layer in engagement with the first fastening material;

a third panel of the subset of the plurality of panels defines a third panel flap positionable between the inner layer and the outer layer in engagement with the second fastening material.

8. A collapsible travel case comprising:

a front panel;

a top panel secured at a first top edge of the top panel to a first front edge of the front panel;

a back panel secured at a first back edge of the back panel to a second top edge of the top panel, the second top edge being on an opposite side of the top panel from the first top edge;

a bottom panel secured at a first bottom edge of the bottom panel to a second back edge of the back panel;

a left panel secured at a first left edge of the left panel to a third top edge of the top panel extending between the first top edge and the second top edge;

a right panel secured to a first right edge of the right panel to a fourth top edge of the top panel extending between the first top edge and the second top edge and positioned opposite the third top edge;

wherein the bottom panel includes:

a second bottom edge selectively securable to a second front edge of the front panel opposite the first front edge;

a third bottom edge selectively securable to a second left edge of the left panel opposite the first left edge; and a fourth bottom edge selectively securable to a second right edge of the right panel opposite the first right edge;

wherein the front panel includes a first front flap secured to a third front edge of the front panel extending between the first front edge and the second front edge and a second front flap secured to a fourth front edge of the front panel opposite the third front edge;

wherein the back panel includes a first back flap secured to a third back edge of the back panel extending between the first back edge and the second back edge and a second back flap secured to a fourth back edge of the back panel opposite the third back edge;

wherein the left panel includes a first left opening along a third left edge of the left panel and a second left opening extending along a fourth left edge of the left panel opposite the third left edge, the third left edge and fourth left edge of the left panel extending between the first left edge and the second left edge;

wherein the right panel includes a first right opening along a third right edge of the right panel and a second right opening extending along a fourth right edge of the right panel opposite the third right edge, the third right edge and fourth right edge of the right panel extending between the first right edge and the second right edge;

wherein the first front flap is selectively securable within the first left opening and the second front flap is selectively securable within the first right opening; and wherein the first back flap is selectively securable within the second left opening and the second back flap is selectively securable within the second right opening.

9. The collapsible travel case of claim 8, wherein the first left opening and the second left opening are defined between an inner left layer and an outer left layer of the left panel and the first right opening and second right opening are defined between an inner right layer and an outer right layer of the right panel.

10. The collapsible travel case of claim 9, further comprising:

first left fastening material secured between the inner left layer and the outer left layer and positioned to engage the first front flap;

second left fastening material secured between the inner left layer and the outer left layer and positioned to engage the first back flap;

first right fastening material secured between the inner right layer and the outer right layer and positioned to engage the second front flap; and second right fastening material secured between the inner left layer and the outer left layer and positioned to engage the second back flap.

11. The collapsible travel case of claim 10, wherein the first left fastening material, second left fastening material, first right fastening material, and second right fastening material are hook-and-loop fastening material.

12. The collapsible travel case of claim 8, wherein:

the top panel defines a top opening with a closure mechanism; and the bottom panel is foldable and insertable within the top opening with each of the front panel, left panel, and right panel folded across the top panel and positioned between the back panel and the top panel.

13. The collapsible travel case of claim 12, wherein the closure mechanism is a zipper extending continuously along the third top edge, the first top edge, and the fourth top edge.

14. The collapsible travel case of claim 13, wherein the zipper includes two zipper pulls configured to allow the closure mechanism to close the top opening along the third top edge and the fourth top edge when the bottom panel is inserted through the top opening.

15. The collapsible travel case of claim 14, wherein the bottom panel includes a stiffening panel and a bottom opening, the stiffening panel being removable from the bottom panel through the bottom opening to enable folding of the bottom panel.

16. The collapsible travel case of claim 15, wherein the bottom opening is closer to the first bottom edge than to the second bottom edge.

* * * * *